United States Patent [19]

Hinkle

[11] 4,452,536

[45] Jun. 5, 1984

[54] CART FOR RELATIVELY SMALL CONCRETE BATCHES AND THE LIKE

[76] Inventor: Edward G. Hinkle, Rte. 4, Box 6, Sand Springs, Okla. 74063

[21] Appl. No.: 366,461

[22] Filed: Apr. 8, 1982

[51] Int. Cl.[3] ..... B01F 7/18; B01F 15/02

[52] U.S. Cl. ..... 366/47; 366/185; 366/194; 366/279

[58] Field of Search ..... 254/96 R, 103; 298/5, 298/6, 7, 2, 8 T, 10, 22 R, 23 R; 366/16, 45, 46, 47, 48, 64, 65, 66, 68, 185, 188, 189, 192, 194, 195, 241, 279, 343, 603, 606; 414/485; 416/210, 227 R

[56] References Cited

U.S. PATENT DOCUMENTS

| | | | |
|---|---|---|---|
| 2,896,770 | 7/1959 | Ross | 366/606 |
| 3,083,057 | 3/1963 | Kiser | 298/7 |
| 3,120,408 | 2/1964 | Pruss | 298/22 R |
| 3,180,628 | 4/1965 | Pullin | 298/22 R |
| 3,227,166 | 1/1966 | Martz | 366/279 |
| 3,235,284 | 2/1966 | Yant | 298/22 R |
| 3,412,883 | 11/1968 | Birdsall | 298/7 |
| 4,058,239 | 11/1977 | Van Mill | 298/7 |
| 4,071,226 | 1/1978 | Miller | 366/64 |
| 4,157,872 | 6/1979 | Davido, Sr. | 366/64 |
| 4,191,478 | 3/1980 | Zupancic | 366/65 |

*Primary Examiner*—Robert W. Jenkins
*Assistant Examiner*—Arthur D. Dahlberg
*Attorney, Agent, or Firm*—Head, Johnson & Stevenson

[57] ABSTRACT

A cart for transporting relatively small batches of concrete mixtures, or the like, and having a reservoir for receiving the components of the concrete therein, an agitator assembly mounted in the reservoir and operable for continuously stirring the mixture during transporting thereof from the site of loading of the cart to the site of utilization of the concrete mixture, a pivotal connection between the cart and a wheeled trailer, a hydraulic cylinder operably connected between the trailer and the cart for selectively pivoting the cart in a rearward direction for discharge of the contents from the cart and pivoting the cart to its normal upright transporting position, and the rear of the cart being of a chute-like configuration for facilitating the discharge of the concrete mixture therefrom.

15 Claims, 9 Drawing Figures

CART FOR RELATIVELY SMALL CONCRETE BATCHES AND THE LIKE

BACKGROUND OF THE INVENTION

1. Field of the Invention

This invention relates to improvements in a cart for transporting concrete mixtures and more particularly, but not by way of limitation, to a cart for transporting relatively small batches of concrete and maintaining the concrete mixture in a desirable and usable condition during the transporting thereof.

2. Description of the Prior Art

Many persons have need for relatively small concrete batches of mixtures for accomplishing small work projects at home, or the like, such as the pouring of a relatively small concrete pad, or other such endeavors. As a result, it is common practice to purchase a small "load" of a concrete mixture normally called "ready mix", which is a load of dry materials and liquid deposited in a common carrier or cart. The loaded cart is normally pulled or towed from the place of purchase to the site wherein the mixture is to be used, and the mixture in the cart frequently separates, at least partially, before the load arrives at the final destination therefor. As a result, the concrete work accomplished with the material may be inferior, the disadvantages of which will be readily apparent.

Many carts for carrying materials of this type have been developed, such as those shown in the Hock U.S. Pat. No. 169,171; Puls Pat. No. 840,656; Turner Pat. No. 1,144,160; Mecking Pat. No. 1,185,338; Jacobs Pat. No. 1,190,417; Chenoweth Pat. No. 1,548,255; Hopkins Pat. No. 2,207,011; Alessio Pat. No. 2,568,678; Mazza Pat. No. 2,678,234; Presler Pat. No. 2,774,456; Kayser Pat. No. 2,811,268; Arce et al. Pat. No. 2,820,672; Ross et al. Pat. No. 2,896,770; Kiser et al. Pat. No. 3,083,057; Pruss Pat. No. 3,120,408; Pullin Pat. No. 3,180,628; Birdsall Pat. No. 3,412,883; Van Mill Pat. No. 4,058,239; Miller Pat. No. 4,071,226 and Davido, Sr. Pat. No. 4,157,872. None of the prior patents, however, solve the aforementioned problem.

SUMMARY OF THE INVENTION

The present invention contemplates a novel cart for transporting relatively small loads of concrete materials, such as that known as "ready mix" and which is particularly designed and constructed for overcoming the foregoing disadvantages. The novel cart comprises a housing having an agitator means provided therein which stirs the mixture in the cart continuously as the cart is being pulled or towed to the site for the use of the contents thereof. Thus, the concrete mixture is in much better condition for use when it reaches the use site than heretofore possible. In addition, the rear portion of the cart is provided with an upwardly extending floor plate and inwardly tapering or converging sidewalls forming a chute at the rear end of the cart. As the hydraulic jack apparatus normally provided at the forward end of the carts of this type is extended for tipping the cart backwardly about a pivot axis, the chute, in the open position thereof, provides an efficient dumping of the concrete mixture into the area to be serviced thereby. The novel cart is simple and efficient in operation and economical and durable in construction.

DETAILED DESCRIPTION OF THE PREFERRED EMBODIMENT

Figure 1:
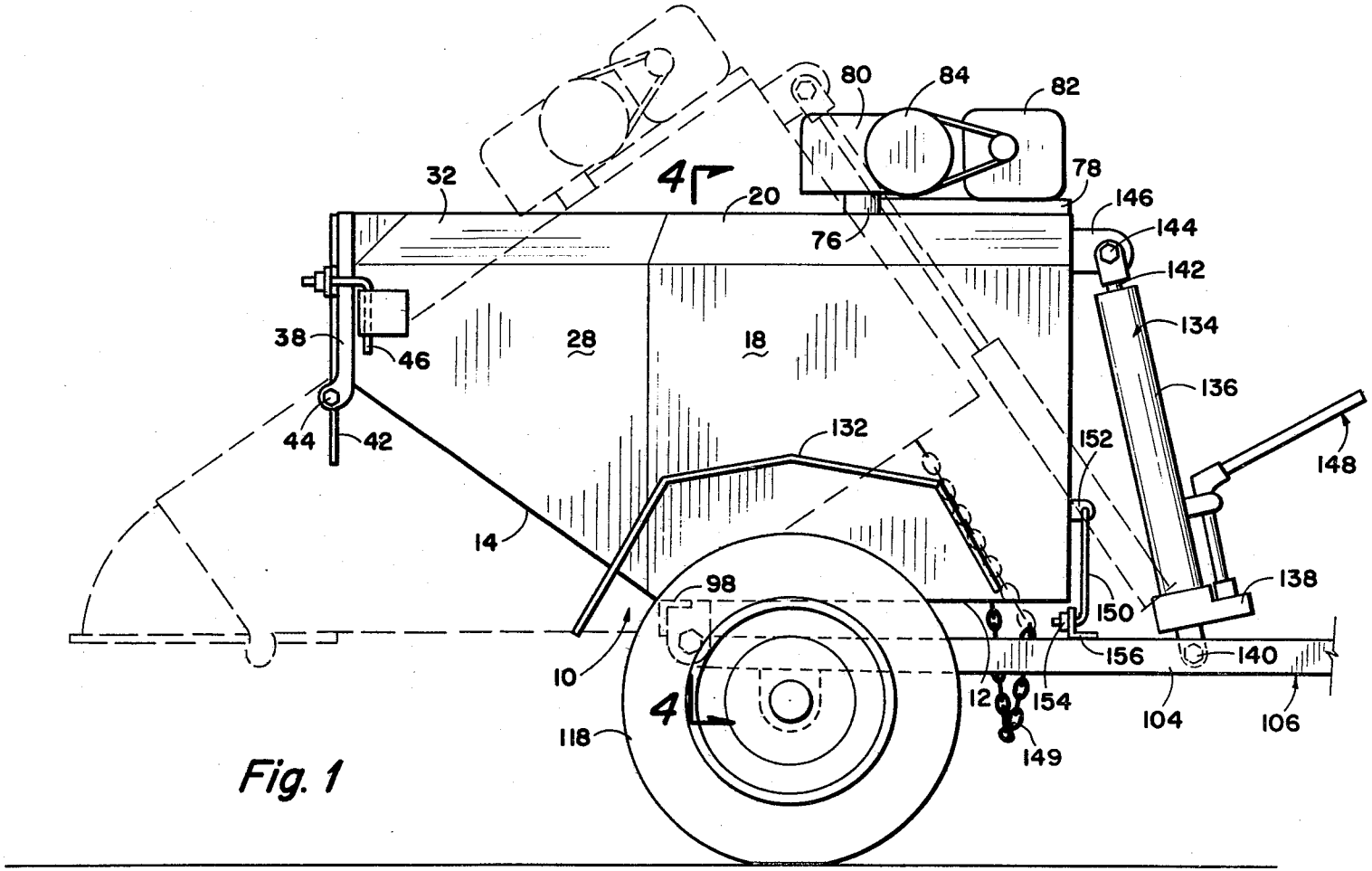
FIG. 1 is a side elevational view of a cart embodying the invention with a towing position thereof being illustrated in solid lines and a dumping position therefor being shown in broken lines.

Referring to the drawings in detail, reference character 10 generally indicates a cart embodying the invention and comprising a first floor or bottom plate 12 conterminous with a second floor or bottom plate 14. The plane of the plate 14 is angularly disposed with respect to the plane of the plate 12 for a purpose as will be hereinafter set forth. A pair of oppositely disposed sidewalls 16 and 18 are secured to the opposite sides of the floor plate 12 and extend substantially perpendicularly outwardly therefrom. The upper end of the sidewalls 16 and 18 are preferably provided with angularly inwardly directed flange members 20 and 22, respectively.

Figure 2:
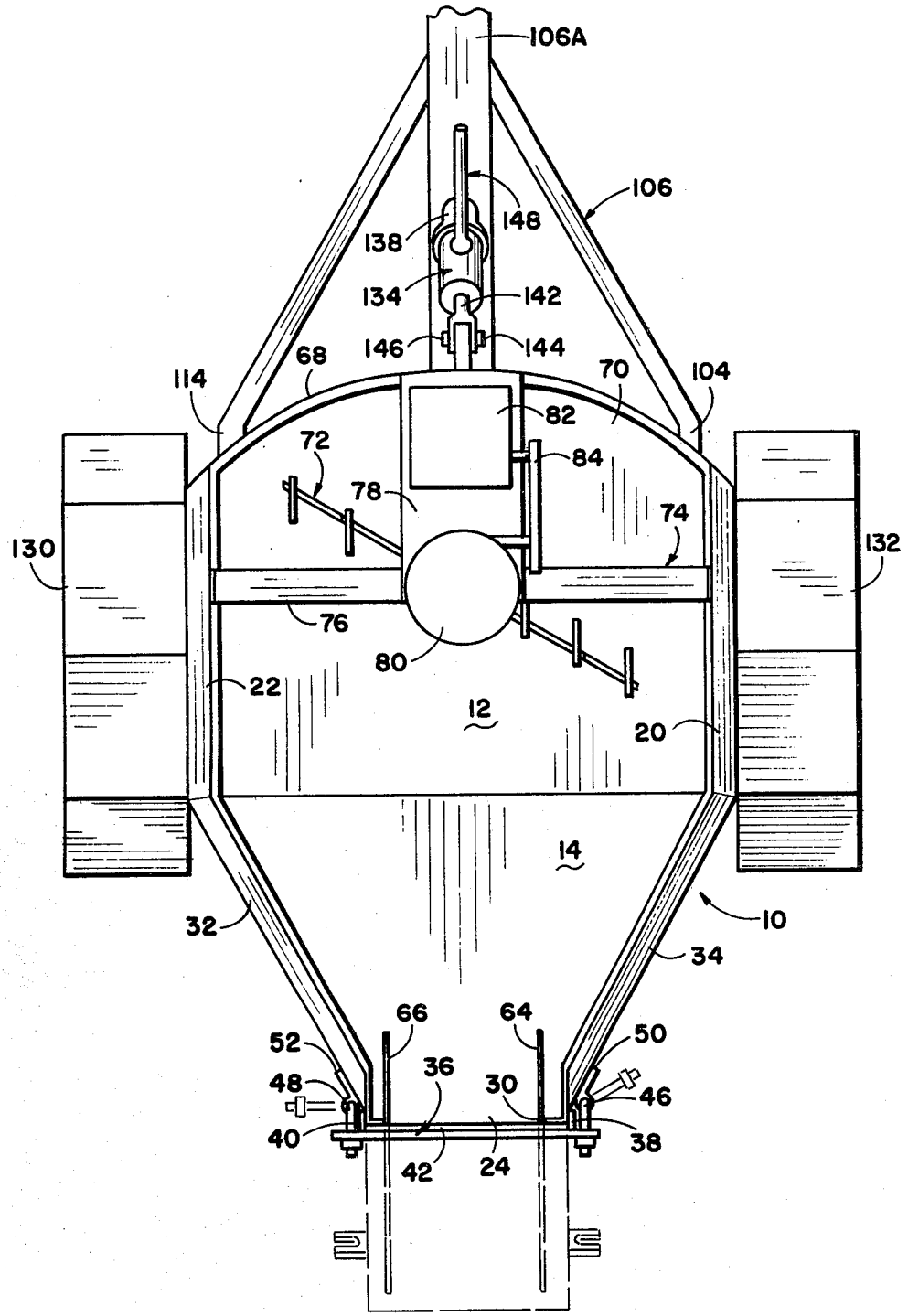
FIG. 2 is a plan view of a cart embodying the invention, with one position shown in solid lines and an alternate position shown in broken lines.

The opposite side edges of the floor plate 14 are convergent toward a centrally disposed substantially rectangular portion 24, as particularly shown in FIGURE 2. The converging edges are provided with sidewalls 26 and 28 extending substantially perpendicularly outwardly therefrom. The inner ends of the sidewalls 26 and 28 are secured to the conterminous edges of the sidewalls 16 and 18, and the lower edges of the sidewalls 26 and 28 are suitably secured to the converging edges of the floor plate 14. The outer end of each of the sidewalls 26 and 28 terminates slightly inwardly of the opposite sides of the rectangular portion 24 to provide an opening 30 (FIG. 2) in communication with the interior of the cart 10. The upper end of the sidewalls 26 and 28 are preferably provided with angularly inwardly directed flange members 32 and 34 having the inner ends thereof suitably secured to the corresponding flanges 20 and 22, and the outer ends thereof terminating at the opening 30. A gate or door assembly generally indicated at 36 is hingedly secured in the proximity of the opening 30 in any well known manner, and as shown herein the gate assembly comprises a pair of spaced elongated side brackets 38 and 40 secured to the sidewalls 26 and 28, respectively, at the opposite sides of the opening 30. A plate means 42 is secured between the brackets 38 and 40 and is pivotally connected therebetween by a hinge pin means 44.

Figure 3:
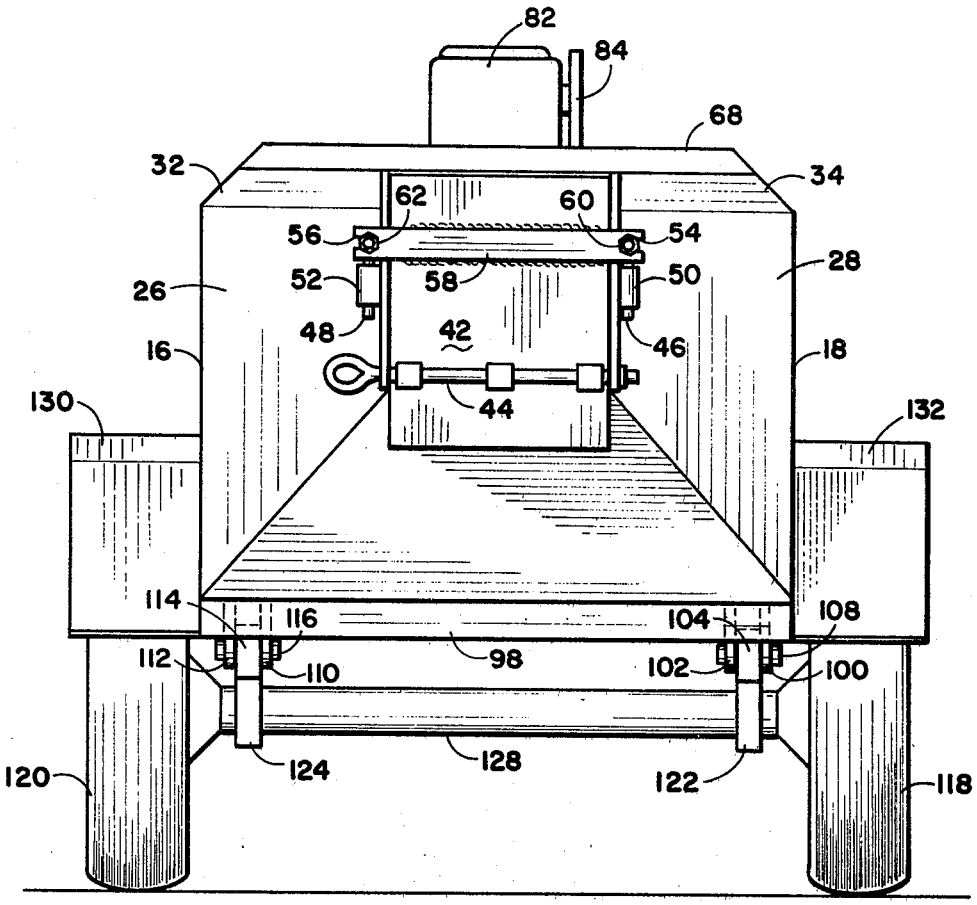
FIG. 3 is a rear elevational view of a cart embodying the invention.

Suitable locking arms or levers 46 and 48 are pivotally secured to the sidewalls 26 and 28 in any suitable manner, such as by straps 50 and 52, and extend outwardly therefrom in a direction toward the plate 42 for engagement with suitable bores or recesses 54 and 56 (FIG. 3) provided in the opposite ends of a bar member 58 welded or otherwise secured to the outer surface of the plate means 42. Bolt heads or nuts 60 and 62 are provided on the outer ends of the levers 46 and 48 for releasably locking the levers in the recesses 54 and 56 for retaining the plate means 42 in a closed position with respect to the opening 30 in one rotative position of the levers. In another rotative position of the levers the bolt heads 54 and 56 may be moved from engagement with the bar 58, thus releasing the plate means 42 for movement away from the opening 30. In addition, a pair of spaced, mutually parallel plates 64 and 66 (FIG. 2) are welded or otherwise secured to the inner face of the plate means 42 and are preferably slidably engagable with the opposite inner sides of the opening 30 all for a purpose as will be hereinafter set forth.

A forward wall 68 is secured between the leading edges of the sidewalls 16 and 18 and flanges 20 and 22 and to the forward edge of the floor plate 12. The wall 68 is preferably of a substantially arcuate planar configuration, as particularly shown in FIG. 2, but not limited thereto. The sidewalls 16, 18, 26 and 28 and the forward wall 68 cooperate to provide a central material receiving reservoir 70 for the cart 10, with the door or gate assembly 36 providing communication between the reservoir 70 and the exterior of the cart. In addition, the angularly disposed inwardly extending flanges 20, 22, 32 and 34 function for reducing or substantially eliminating loss of the materials through the open upper end of the reservoir 70, as will be hereinafter set forth.

An agitator assembly 72 is disposed within the reservoir 70 and is suitably mounted between the inner surface of the floor plate 12 and a support assembly 74 secured to the open upper end of the reservoir 70. The support assembly 74 preferably comprises a cross bar 76 extending between the upper edges of the flanges 20 and 22 and secured thereto in any well known manner, and a centrally disposed plate 78 secured between the cross bar 76 and the upper edge of the forward wall 68. A gear box assembly generally indicated at 80 is mounted on the plate 78 and is operably connected with the agitator assembly 72 for actuation thereof as will be hereinafter set forth. A motor or other suitable power plant or source 82 is mounted on the plate 78 and is operably connected with the gear box 80 in any well known manner, such as a pulley and belt arrangement shown at 84. Whereas the power plant 82 may be operably connected with the electrical system of a towing vehicle (not shown), it is preferable that the power source 82 be of a self-contained type. Still another method for rotation of the agitator assembly 72 may be the use of a hydraulic motor (not shown) and motor-driven pump (not shown) wherein the hydraulic motor may be mounted beneath the floor plate 12 with the rotatable post 86 extending through the plate to facilitate coupling thereof with the motor. Suitable flexible hoses (not shown) may be utilized to connect the hydraulic motor with the motor pump and the motor pump could be mounted on the tongue of the A-frame trailer 106.

Figure 4:
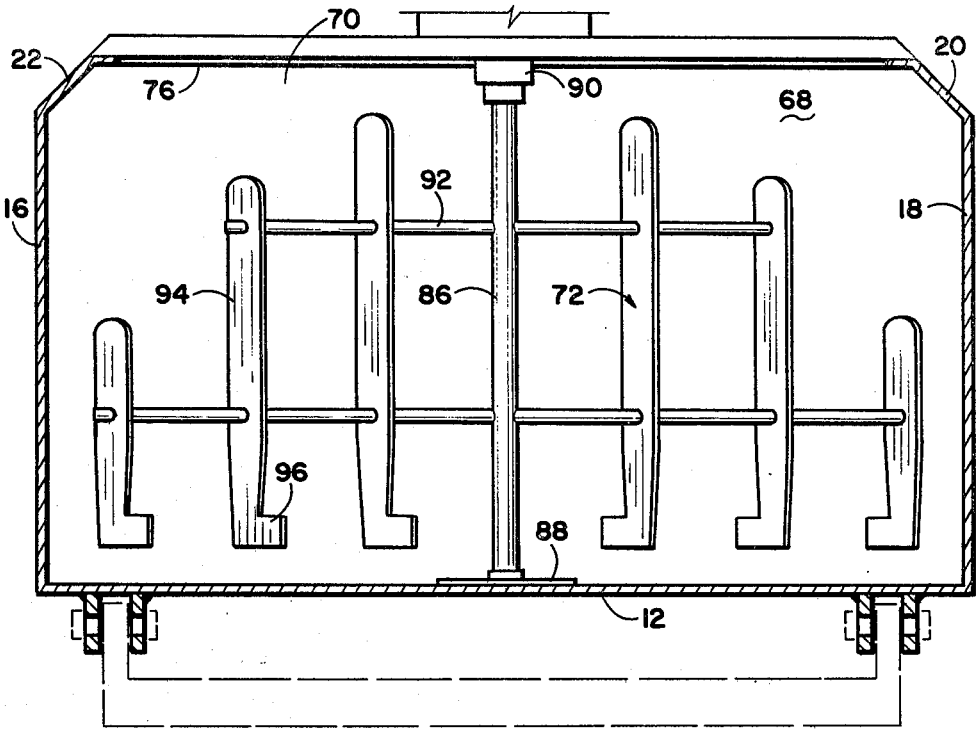
FIG. 4 is a view taken on line 4—4 of FIG. 1.
Figure 5:
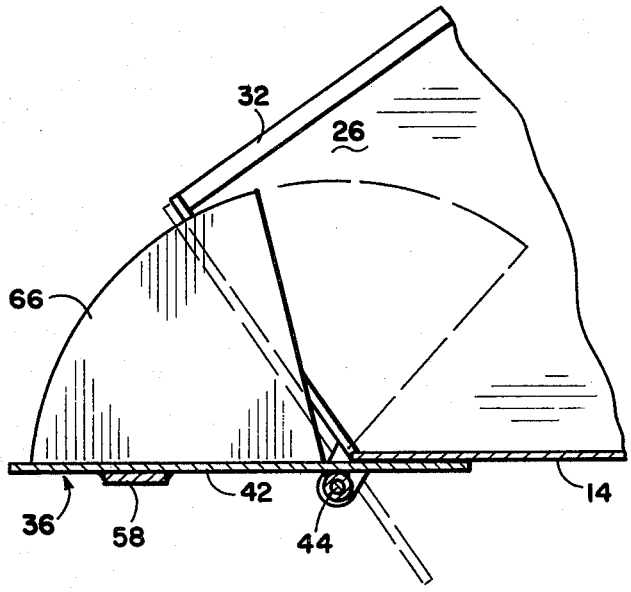
FIG. 5 is a side elevational view of the rear portion of a cart embodying the invention showing a dumping position therefor, and with portions shown in broken lines for purposes of illustration.

The agitator assembly 72 comprises a centrally disposed rotatable post 86 suitably journalled between a base plate 88 mounted on the floor plate 12 and a bearing or support housing 90 secured to the cross bar 76 and/or plate 78. A plurality of substantially mutually parallel arms 92 are secured to the outer periphery of the post 86 in longitudinally spaced relationship and extend radially outwardly therefrom for supporting a plurality of substantially vertically disposed spaced agitator blades 94. The blades 94 are preferably of a substantially identical configuration, with the exception of the overall size thereof. The blades 94 preferably being progressively smaller in length as the distance from the post 86 increases. In other words, the blades 94 disposed in the nearest proximity of the post 86 are of a greater length than the blades 94 spaced outwardly therefrom. Each blade 94 is of a substantially flat construction and of a substantially L-shaped planar configuration with the smaller leg 96 of the E11 being disposed in spaced relation with respect to the inner surface of the floor plate 12, as will be particularly seen in FIG. 4. The plane of each blade 94 is canted with respect to the longitudinal axis of the support arms 92, as particularly evident in FIG. 2. In addition, the blades 94 disposed on one side of the post 86 are arranged with the legs 96 thereof extending in an opposite direction with respect to the legs 96 of the oppositely disposed blades 94 in order to facilitate the use of the agitator assembly 72 as will be hereinafter set forth.

The plate 12 is provided with a transversely extending angle member 98 preferably disposed at the juncture between the plates 12 and 14. A first pair of spaced apertured flanges 100 and 102 are secured to the angle 98 and bottom surface of the plate 12 in any well known manner for receiving a first leg 104 of a suitable A-frame trailer 106 therebetween. The leg 104 is provided with an aperture (not shown) in substantial alignment with the apertures of the flanges 100 and 102 for receiving a pivot shaft 108 therethrough. A second pair of spaced apertured flanges 110 and 112 are similarly secured between the angle member 98 and the bottom surface of the floor plate 12 in spaced relation with respect to the first flanges 100 and 102 and receive a second leg 114 of the A-frame 106 therebetween. The leg 114 is similarly provided with an aperture (not shown) for cooperating with the flanges 110 and 112 to support a pivot shaft 116 in substantial axial alignment with the pivot shaft 108. In this manner, the cart 10 is pivotally secured to the A-frame trailer 106 for a purpose as will be hereinafter set forth.

The trailer 106 is provided with a pair of spaced axially aligned wheels 118 and 120 which may be secured to the A-frame 106 in any suitable manner. As shown herein, the legs 104 and 114 are provided with spaced downwardly extending apertured blocks 122 and 124 for receiving an axle 126 therethrough, the axle 128 having the wheels 118 and 120 suitably secured to the opposite ends thereof as is well known. In this manner the cart 10 is also connected with the wheels 118 and 120 for facilitating transporting of the cart during use thereof. It may also be preferable to secure suitable fenders or deflectors 130 and 132 to the outer surfaces of the sidewalls 16 and 18 and in the general proximity of the wheels 118 and 120 for protection of the cart 10 from debris, and the like, during transporting thereof.

A suitably hydraulic cylinder 134, or the like, is secured between the front wall 68 and the A-frame 106 in any suitable manner, and as shown herein the cylinder housing 136 of the hydraulic cylinder 134 is suitably mounted on a flange member 138 which in turn is pivotally secured to the A-frame 106 as shown at 140. The piston rod 142 of the hydraulic cylinder 134 is pivotally secure at 144 to an outwardly extending flange 146 secured to the outer surface of the front wall 68. A control lever assembly 148 is mounted on the flange means 138 and is operably connected with the hydraulic cylinder 134 for actuation thereof as is well known. The lever assembly 148 may be utilized for selectively extending the rod 142 axially outwardly from the cylinder housing 136 in order to tilt the cart 10 in a rearward direction about the pivot shafts 108 and 116 and to the position shown in broken lines in FIG. 1, and alternately withdrawing or contracting the rod 142 into the cylinder housing 136 for moving the cart 10 to a substantially upright position, as shown in solid lines in FIG. 1.

It is desirable to provide a stop means for limiting the rearward tilting of the cart 10 about the shafts 108 and 116, and as shown herein, a length of chain 149 may be anchored between the plate 12 and the A-frame 106, said chain being of a preselected length for limiting the movement of the cart 10 in the rearward direction. Similarly, it is preferable to provide a locking means for securely retaining the cart 10 in the upright position therefor, and as shown herein, a locking linkage member 150 is pivotally secured at one end to an aperture bracket member 152 provided on the outer surface of the front wall 68. The outer end of the link member 150 is provided with locking hook means 154 for releasable engagement with an apertured angle member 156 mounted on the A-frame 106. The link member 150 may be engaged with the angle member 156 when the cart 10 is disposed in the upright position thereof shown in solid lines in FIG. 1, and may be manually released from the engagement with the angle member 156 when it is desired to tilt the cart 10 to the position shown in broken lines in FIG. 1.

In use, the necessary dry and liquid material required for the mixing of a desired concrete batch, or the like, may be deposited in the reservoir 70 and the cart 10 may be transported from the site of loading thereof to the site for use of the concrete mixture (not shown) by securing the A-frame trailer 106 to a suitable towing vehicle (not shown) in the usual or well known manner. As the cart 10 travels from the first site to the site for use of the materials carried in the reservoir 70, the power plant 82 is preferably activated whereby the agitator assembly 72 is in constant operation. The post 86 rotates for moving the blades 94 through the materials disposed in the reservoir 70, thus constantly stirring the mixture to substantially preclude any undesirable separation of the components of the mixture during the transporting thereof. The inwardly directed angular flanges 20, 22, 32 and 34 facilitate the retaining of the moving mixture within the reservoir, thus minimizing any loss of the materials during the mixing operation.

When the cart 10 arrives at the desired destination for use of the concrete mixture contained therein, the cart 10 may be positioned at an optimum placement with respect to the area for use of the concrete mixture. The latching link member 150 may be manually released from engagement with the angle member 156, and the lever means 148 may be manually actuated for extending the rod 142 from the cylinder housing 136, thus moving the cart 10 to the position shown in broken lines in FIG. 1. When the cart 10 has reached the desired tilted position therefor, the actuation of the hydraulic cylinder 134 may be ceased.

The operation of the cart 10 is generally similar to the operation of any well known dump bed vehicle wherein it is the usual practice to unlatch the tail-gate before tilting of the dump bed. The door assembly 36 may be released by removing the levers 46 and 48 from the engagement with the bar 58, and this may be done without the concrete mixture being discharged from the cart since the door is pivoted from the bottom instead of the top thereof, the common present day tail gates being normally pivoted at the top. As the cart 10 is moved to the position shown in broken lines in FIG. 1, the mixture will pour over the top at a rate proportional to the rate of extension of the rod 142. The agitator assembly 72 should be rotating during a discharge operation in order to facilitate the movement of the semi-liquid mixture from the interior of the cart. It is to be noted that the plates 64 and 66 form a chute at the opening 30 for also facilitating the discharge of the concrete mixture into a preselected area wherein the mixture is to be utilized.

Of course, as soon as the contents of the reservoir 70 have been discharged, the lever means 148 may be manually actuated for withdrawing the rod 142 into the cylinder housing 136, whereupon the cart 10 is pivoted toward the upright position therefor. The door assembly 36 may be moved to the closed position therefor with respect to the opening 130, and the latching link 150 may be engaged with the angle member 156. Of course, the actuation of the agitator assembly 72 may be ceased by cessation of the operation of the power plant 82 when the agitation or stirring action is no longer required.

Figure 6:
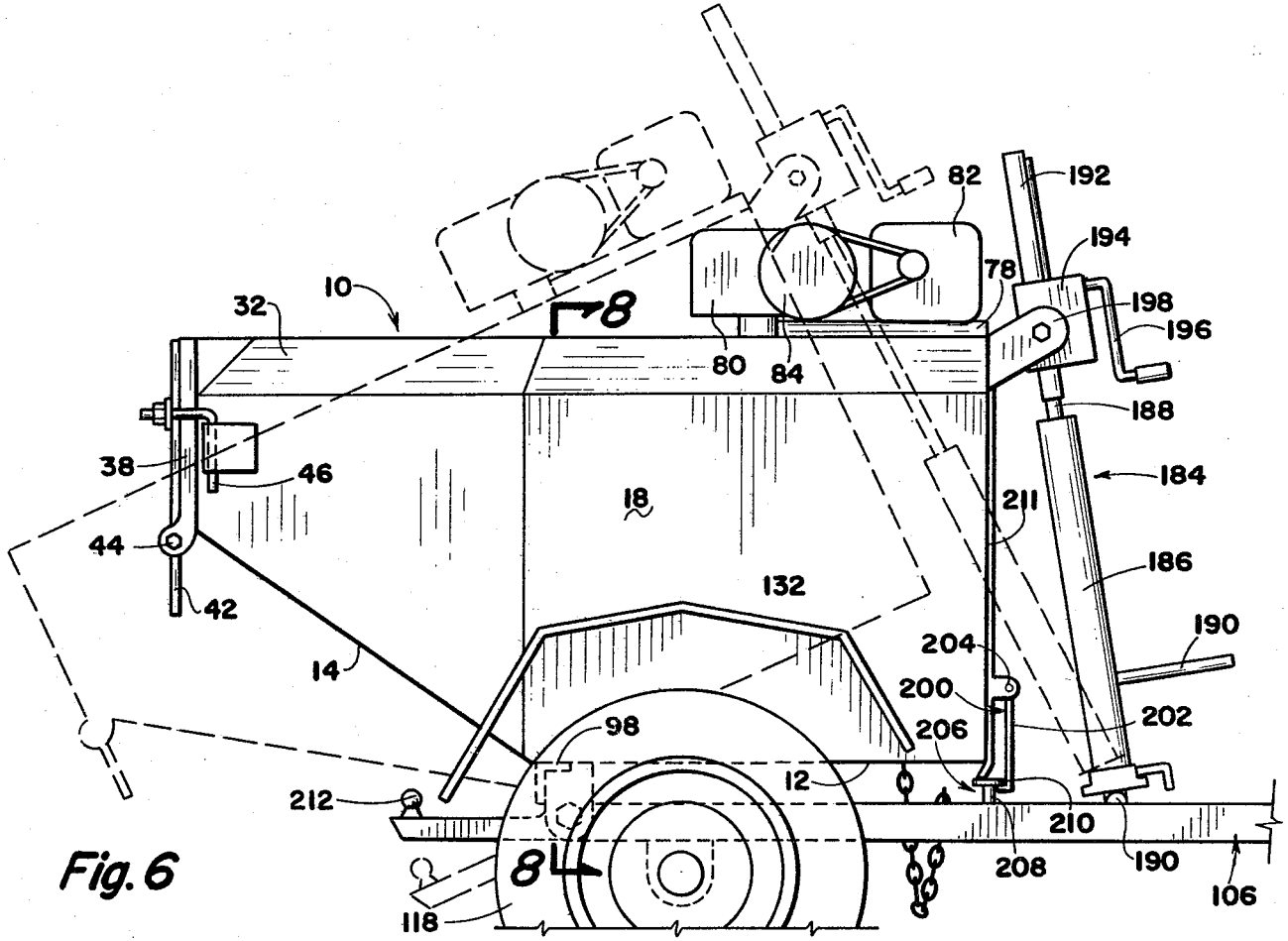
FIG. 6 is a side elevational view of a modified cart embodying the invention, with a towing position thereof shown in solid lines and one dumping position therefor shown in broken lines for purposes of illustration.
Figure 7:
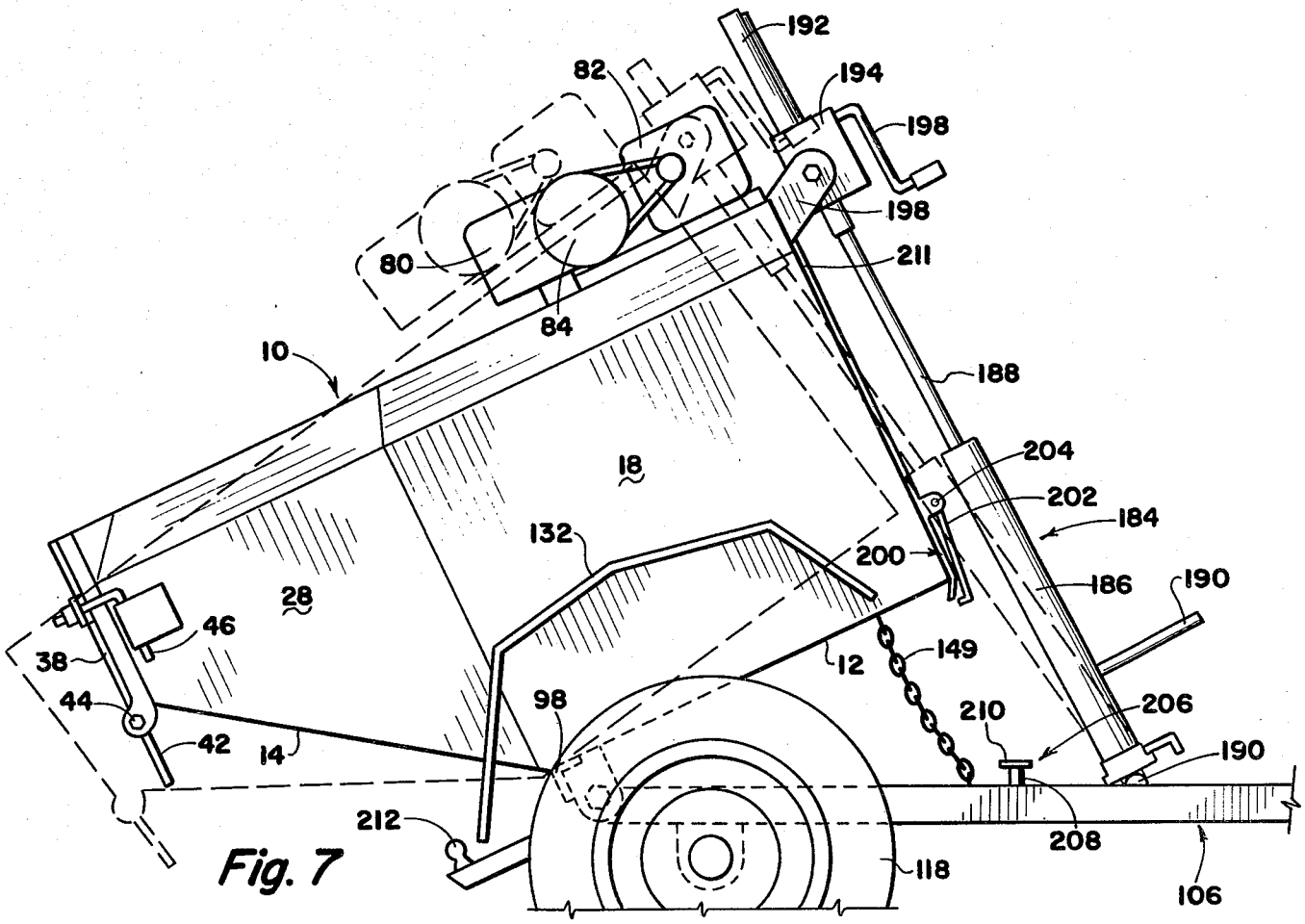
FIG. 7 is a view similar to FIG. 6 showing the dumping position of FIG. 6 in solid lines and another dumping position in broken lines.
Figure 8:
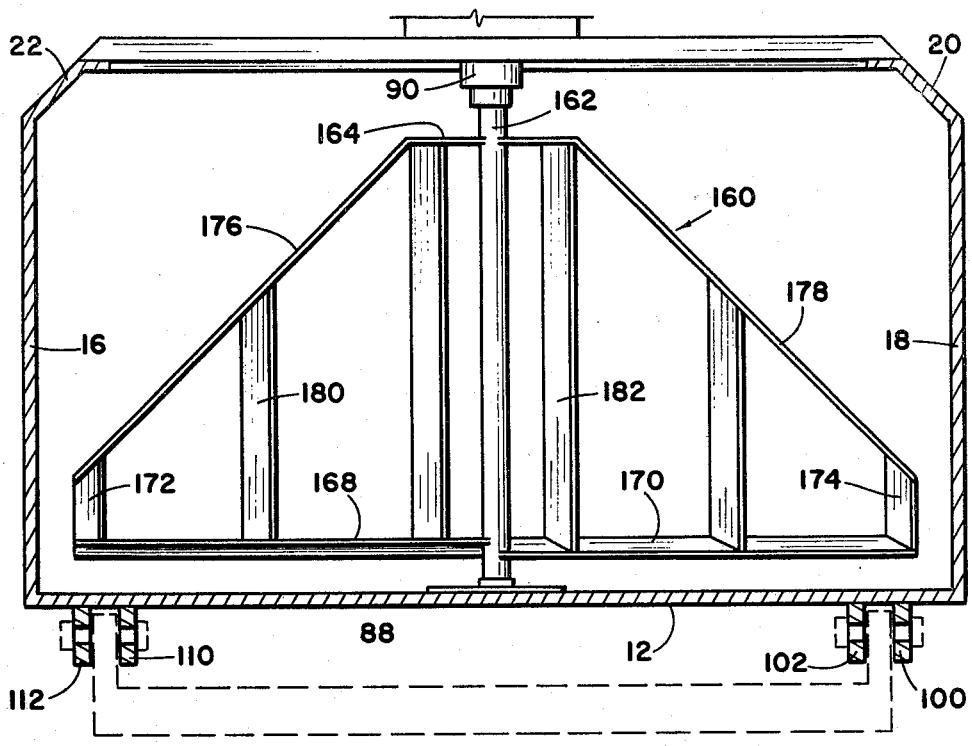
FIG. 8 is a view taken on line 8—8 of FIG. 6.

Referring now to FIGS. 6 through 8, the cart 10 is provided with a modified agitator assembly 160 comprising a central rotatable post 162 generally similar to the post 86 and suitably journalled between the base plate 88 and the bearing or support housing 90 as hereinbefore set forth. A pair of relatively short arms 164 and 166 are secured to the outer periphery of the post 162 in any suitable manner in the proximity of the housing 90, and extend radially outwardly from the post in opposite directions as particularly shown in FIG. 8. A second pair of arms 168 and 170 are similarly secured to the outer periphery of the post 162 and are disposed in the proximity of the plate 88. The arms 168 and 170 are substantially longer than the arms 164 and 166, and are each canted about its own longitudinal axis or disposed at an angle with respect to the plane of the bottom plate 12 of the cart 10. The plane of the arm 168 is angularly disposed in a direction opposite with respect to the plane of the arm 170. First and second baffle members 172 and 174 are secured at the outer ends of the arms 168 and 170, respectively, and extend substantially perpendicularly therefrom in a direction toward the arms 164 and 166. The baffles or blades 172 and 174 and the plane of each blade is angularly disposed with respect to the plane determined by the longitudinal axes of the arms 172–170 and post 162, and parallel with respect to each other. The baffles 172 and 174 are connected to the arms 164 and 166 by angularly disposed arm members 176 and 178, respectively. A plurality of baffles or blades 180 are secured between the arms 168 and 176 in spaced relation, and each is preferably canted or angularly disposed in substantially parallel relationship with the blade 172. A plurality of similar blades 182 are secured between the arms 170 and 178 in spaced relation and substantially parallel with respect to the blade 174.

The particular design and configuration of the agitator assembly 160 requires less power for operation and agitates the mixture within the cart in a more efficient manner in that the mixing takes place only where it is needed.

The cart 10 shown in FIGS. 6 through 8 is also provided with a modified body-tilting assembly 184 which comprises a first fluid cylinder 186 generally similar to the cylinder 134 and having an extensible and contractable rod 188 and actuator lever 190. The cylinder 186 has one end pivotally secured to the A-frame 106 in any suitable manner, such as by a roll bar 190, and is movable between the position shown in solid lines in FIG. 6 and the position shown in broken lines in FIG. 7, as will be hereinafter set forth.

A suitable rack-type gear 192 is secured to the outer end of the rod 188 and extends axially outwardly therefrom through a suitable worm gear assembly 194. An actuator handle means 196 is operably connected with the worm gear assembly 194 for actuation thereof, and the assembly 194 is secured to the forward wall 68 by suitable flanges or bracket means 198, only one of which is shown in the drawings. When the body of the cart 10 is to be moved from the normal towing position shown in solid lines in FIG. 6 to a dumping position as shown in broken lines of FIG. 6 and further shown in solid lines in FIG. 7, the cylinder 184 may be actuated in the usual manner for extending the rod 188 and moving the cart 10 into the position shown in broken lines in FIG. 6. In the event it is desired or necessary to tilt the cart 10 further, the handle means 196 may be utilized for rotating the worm gear assembly 194 for movement thereof longitudinally along the rack member 192, thus moving the cart 10 through a further pivotal angle and to the position shown in broken lines in FIG. 7. Of course, the operation may be reversed for returning the cart to the normal towing position therefor.

The cart 10 as shown in FIGS. 6 through 8 is further provided with a modified latching hook means 200 which comprises a hook member 202 generally similar to the hook 150 and having one end pivotally secured to the cart 10 at 204 and the opposite end selectively engagable with an adjustable pedestal member 206. The pedestal member 206 may be secured to the A-frame 106 in any suitable manner and comprises a post member 208 having an enlarged head member 210 at the outer end thereof engagable by the hook 202. In addition, a post or support member 211 secured to the plate 28 rests on the head member 210 when the cart 10 is in the towing position. The post 208 is movable between a contracted position and extended position with respect to the upper limit of the A-frame 106 in order to alter the position of the head member 210. It is desirable that the cart 10 be maintained with the bottom plate 12 in a substantially horizontal position during transporting thereof, and the position of the head 210 may be selected in accordance with the relative size or height of the trailer hitch of the towing vehicle (not shown). When the cart 10 is to be tilted rearwardly to a dumping position, the hook member 202 may be disengaged from the head member 210 to permit free movement of the cart. When the cart 10 is returned to the normal upright or towing position, the hook 202 may be engaged with the head member 210 for securely retaining the cart in the preferred towing position.

Figure 9:
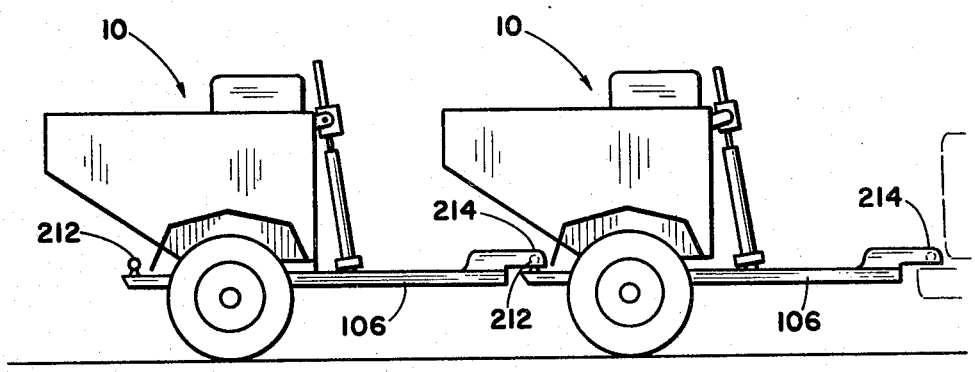
FIG. 9 is a side elevational view of a pair of carts embodying the invention illustrated in an in-line towing position.

Referring now to FIG. 9, the upwardly extending angular configuration of the plate member 14 provides sufficient space for extending central member 106A beyond the flanges 100, 102, 110 and 112 for receiving a suitable ball member 212 to provide a ball hitch for the rear portion of the cart 10. In this manner, a pair of carts 10 may be coupled in end-to-end relation for towing behind a common towing vehicle (not shown). It will be apparent that the distance between the ball 212 and the axle center is relatively short with relation to the distance from the axle center to the forwardly disposed front hitch member 214. This provides for a very stable "rig" during transporting thereof over a highway or road, with considerably less weaving that would ordinarily be encountered when towing two in-line carts. In addition, the upwardly extending configuration of the plate or floor 14 greatly facilitates accessibility to the ball member 21 for ease of hitching one cart to another.

From the foregoing it will be apparent that the present invention provides a novel cart for transporting relatively small quantities of concrete mixtures, or the like, and comprising a cart member pivotally secured to a wheeled trailer adapted to be towed behind a vehicle, said cart having agitator means mounted therein for continuously stirring or mixing the components of the concrete mixture within the cart as the cart is transported from a site of loading to a site for use of the concrete mixture. The rear portions of the cart are configured with converging sidewalls forming a chute-like construction with a door hingedly secured to an opening provided at the end of the chute-like member. The cart may be pivoted in a rearward direction for discharge of the contents thereof through the chute and open door, and may be returned to a substantially upright position subsequent to discharge of the mixture from the interior of the cart. The continuous mixing of the concrete mixture during the transporting thereof to the site of use substantially eliminates separation of the components of the mixture thus providing an efficient concrete mixture at the construction site, or the like, wherein the mixture is to be utilized.

Whereas the present invention has been described in particular relation to the drawings attached hereto, it should be understood that other and further modifications, apart from those shown or suggested herein may be made within the spirit and scope of this invention.

What is claimed is:

1. In combination with a wheeled trailer, a cart pivotally secured to the trailer for pivoting in alternate rearward and forward directions to provide a transporting position and materials discharging position for the cart, a materials receiving reservior provided in the cart, chute-like means providing communication between the reservoir and the exterior of the cart for facilitating discharge of the materials therefrom, agitator means disposed within the reservoir for continuous stirring of the materials during transporting thereof in the cart, and wherein the cart comprises a six-sided housing having a first bottom plate pivotally secured to the trailer and a second bottom plate conterminous with the first bottom plate and extending at a planar angle with respect thereto, said second bottom plate having converging side edges cooperating with two of the six sides of the housing to provide said chute-like means.

2. In combination with a wheeled trailer, a cart as set forth in claim 1 wherein the chute-like means is provided with an opening at the outer end thereof, and door assembly means is pivotally secured in the proximity of the opening for alternate opening and closing thereof.

3. In combination with a wheeled trailer, a cart pivotally secured to the trailer for pivoting in alternate rearward and forward directions to provide a transporting position and materials discharging position for the cart, a material receiving reservoir provided in the cart, chute-like means providing communication between the reservoir and the exterior of the cart for facilitating discharge of the materials therefrom, agitator means disposed within the reservoir for continuous stirring of the materials during transporting thereof in the cart, and including fluid cylinder means pivotally secured to the trailer, rack and gear means secured between the cart and the fluid cylinder, said fluid cylinder cooperating with the rack and gear means for providing first and second pivotal dumping positions for the cart.

4. In combination with a wheeled trailer, a cart as set forth in claim 3 and including fluid cylinder means interposed between the cart and the trailer for providing said pivoting of the cart.

5. In combination with a wheeled trailer, a cart as set forth in claim 3 wherein the agitator means includes power means mounted on the cart for actuation thereof. assembly means is pivotally secured in the proximity of the opening for alternate opening and closing thereof.

6. In combination with a wheeled trailer, a cart as set forth in claim 3 the agitator means comprises a central post means journalled within the reservoir, a plurality of spaced support arm members extending radially outwardly from the central post means, blade means secured to the support arm members and disposed substantially parallel with the longitudinal axis of the central post means for moving through the materials in the reservoir upon rotation of the central post means about its own longitudinal axis.

7. In combination with a wheeled trailer, a cart as set forth in claim 6 wherein the blade members are of a substantially flat L-shaped configuration, with the plane of the blade members being canted with respect to the longitudinal axis of the support arm members.

8. In combination with a wheeled trailer, a cart as set forth in claim 7 wherein the overall length of the blade members decreases in proportion to the distance thereof from the central post means.

9. In combination with a wheeled trailer, a cart as set forth in claim 7 wherein the lowermost leg of the L-shaped configuration is spaced inwardly from the bottom of the cart.

10. In combination with a wheeled trailer, a cart as set forth in claim 3 and including limiting means for limiting the rearward pivotal movement of the cart.

11. In combination with a wheeled trailer, a cart as set forth in claim 1 and including hitch means secured to the rearward portion of the cart for facilitating securing of two of the carts in in-line relation for towing simultaneously by a common towing vehicle.

12. In combination with a wheeled trailer, a cart as set forth in claim 1 wherein the agitator means comprises a centrally disposed rotatable post member journalled within the reservoir, substantially identical oppositely disposed frame means secured to the post member for rotation simultaneously therewith, and a plurality of substantially mutually parallel spaced blades secured within the frame means for moving through the material in the reservoir upon rotation of the central post means about its own longitudinal axis.

13. In combination with a wheeled trailer, a cart as set forth in claim 12 wherein the frame means includes at least one radially outwardly extending arm member having the transverse plane thereof angularly disposed with respect to the plane of the bottom of the cart.

14. In combination with a wheeled trailer, a cart as set forth in claim 12 wherein the transverse plane of the blades is angularly disposed with respect to the direction of rotation of the agitator apparatus.

15. In combination with a wheeled trailer, a cart as set forth in claim 3 and including adjustable pedestal means secured to the trailer, and hook means secured to the cart for selective engagement with the pedestal means for securing the cart in the normal towing position therefor.

* * * * *